United States Patent [19]

Schmid

[11] Patent Number: 4,494,595

[45] Date of Patent: Jan. 22, 1985

[54] TEMPERATURE-CONTROLLABLE HEAT VALVE

[76] Inventor: Lawrence A. Schmid, 12 Maplewood Ct., Greenbelt, Md. 20770

[21] Appl. No.: 556,480

[22] Filed: Nov. 30, 1983

[51] Int. Cl.[3] ..... F28F 13/00

[52] U.S. Cl. ..... 165/1; 165/32; 165/96; 165/104.22

[58] Field of Search ..... 165/32, 96, 104.22

[56] References Cited

U.S. PATENT DOCUMENTS 3,543,839 12/1970 Shlosinger ..... 165/96

4,099,556 7/1978 Roberts ..... 165/96

FOREIGN PATENT DOCUMENTS 932187 5/1982 U.S.S.R. ..... 165/96

*Primary Examiner*—Albert W. Davis, Jr.

*Attorney, Agent, or Firm*—Sughrue, Mion, Zinn, Macpeak & Seas

[57] ABSTRACT

The basic heat pipe principle is extended by providing means for interrupting and modulating the return of liquid condensate to the evaporator end of the heat pipe. This is done by interposing a metallic screen (called the control grid) in the fluid path. This will stop the flow if the pressure drop across the screen is insufficient to overcome the resistance offered by surface tension. Because this surface tension increased as the temperature of the control grid decreases, the resistance of the screen, and hence the strength of the return flow of condensate to the evaporator, can be varied by changing the temperature of the control grid. This control temperature can be considerably lower than the operating temperature of the heat pipe, which means that low-temperature control devices can be used to control high-temperature heat flow.

18 Claims, 15 Drawing Figures

FIG. 6a
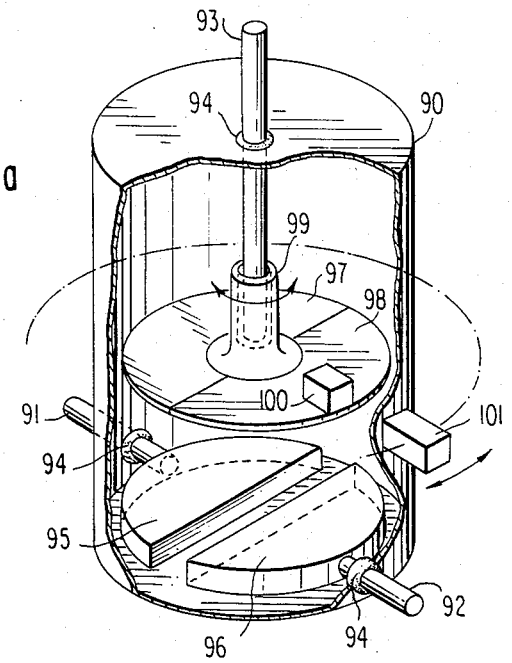
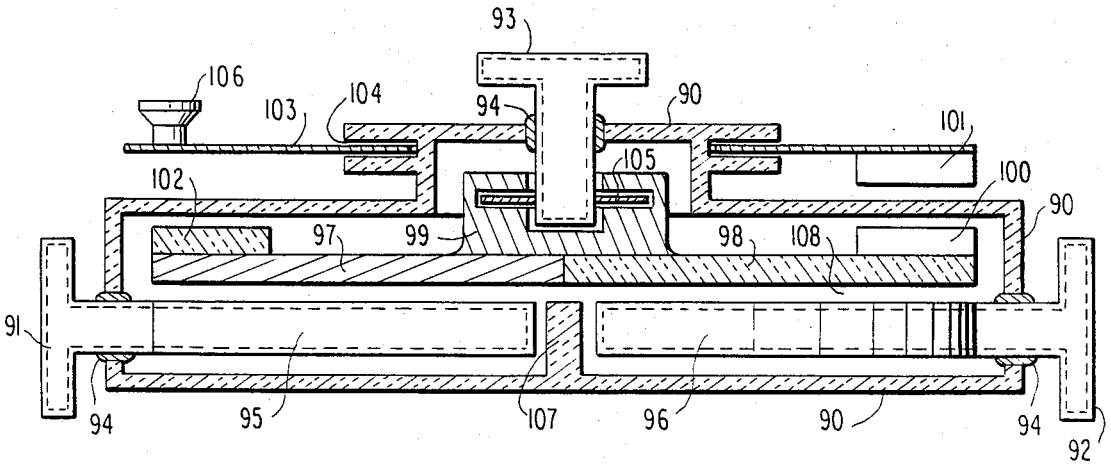
FIG. 6b

DEFINITIONS OF SYMBOLS $$T_c = \alpha T_a + (1-\alpha) T_b$$

$$T_c = \frac{R_2 T_a + R_1 T_b}{R_1 + R_2}$$

TEMPERATURE DIVIDER

NEGATIVE-FEEDBACK THERMAL AMPLIFIER

POSITIVE-FEEDBACK THERMAL AMPLIFIER

HEAT VALVE USED AS VARIABLE-BIAS DIODE

RELAXATION OSCILLATOR

HEAT VALVE USED AS VARIABLE-BIAS DIODE

TEMPERATURE REGULATOR

TEMPERATURE-CONTROLLABLE HEAT VALVE

The invention described herein may be manufactured and used by or for the Government of the United States of America for all governmental purposes without the payment of any royalty.

BACKGROUND OF THE INVENTION

1. Field of the Invention

This invention relates generally to the field of controllable heat pipes and, more particularly, to controllable heat-valves which are controllable by a control temperature.

2. Description of the Prior Art

Heretofore, most of the commercial applications of heat pipes and heat siphons have concentrated either on the removal of heat from places that are inaccessible to the passage of a cooling fluid, as in the cooling of concentrated arrays of electronic equipment or heat removal from interior regions during die casting, or on the transfer of heat from a region where it is harmful or wasted to a region where it can be put to good use, as in the case of heat transfer from the hot sunlit side of a spacecraft to the cold shadow side or the transfer of waste chimney heat to a site where it can be used for space heating or industrial processing. These applications are characterized by the fact that the heat pipe must function continuously as long as the heat source generates heat. The requirement to maintain the constancy of the temperature at which electronic equipment operates has also led to the invention of sundry methods for causing the effective thermal conductance of a heat pipe to vary automatically in such a way as to cause a diminishment in the variations in temperature of the heat source to which the evaporator end of the heat pipe is attached. The most common approach involves the inclusion of a quantity of inert gas in the heat pipe or in a connecting reservoir in such a way that it competes with the working fluid vapor arriving from the evaporator for access to the condenser region of the pipe. (See ref. 1 for details.)

An entirely different category of applications is, however, becoming feasible that requires the capability of switching heat pipes on and off and regulating their effective thermal conductances continuously between these extremes. For example, it is well known that it is possible to store a great quantity of high-temperature heat energy in the form of metallic vapor contained in an insulated tank, but to tap this energy for metallurgical or other industrial processing, or for conversion into mechanical or electrical energy by means of a Stirling engine, it is necessary not only to transport the heat from the reservoir where it is stored to the site where it is needed, but also to be able to turn the heat supply on and off in a manner analogous to the control of the flow in a hydraulic line by means of a valve inserted in the line. There have been some inventions that modify heat pipes so as to provide this capability (reviewed in ref. 1), and these can be divided into two categories: those that require the availability of electrical energy, and those that can operate from the same heat supply that feeds the heat pipe. When electrical energy is readily available and the immediate environment of the heat pipe is not hostile to the necessary electronic controls, then there exist several satisfactory means for making a heat pipe function as an on-off switch, and, although it is considerably more difficult to provide continuous variation of the effective conductance between the extremes of on and off, certain of the electrical methods can also provide this capability. If, however, electrical energy is not available, or if very high temperatures are involved that require elaborate shielding and cooling of the electronic control equipment, or if the heat pipe is used to conduct heat from a nuclear reactor in the proximity of which electronic equipment would soon be destroyed because of radiation, or if the heat valve is part of a system that must operate unattended for long periods of time in remote or inaccessible locations so that repair or battery replacement is not possible, then it is necessary that the heat valve be powered solely by a heat source, and that it be robust, durable, and reliable. These requirements, in turn, make it very desirable that the heat valve not contain any mechanically moving parts which would be subject to mechanical fatigue. This would eliminate the inclusion of bimetallic strips or liquid filled bellows within the heat pipe for the purpose of opening or closing a break in the wick that returns the condensate to the evaporator (cf. U.S. Pat. No. 3,519,067). This invention, incidentally, intended that the bimetallic strips or bellows be activated by the temperature applied to the evaporator end of the heat pipe so that the device would serve to smooth out variations in the temperature of the heat source, rather than act as a thermal on-off switch.)

A more promising proposal was made by R. D. Moore, Jr. in U.S. Pat. No. 3,818,980. Moore proposed regulating the conductance of the heat pipe by varying the amount of working fluid contained in it. This would be done by connecting the pipe to an external reservoir whose temperature could be independently controlled. If this temperature were below the operating temperature of the heat pipe, the vapor pressure in the reservoir would be less than that in the heat pipe, and vapor would flow from the pipe into the reservoir where it would condense and be held in a wick. Thus deprived of its working fluid, the heat pipe would cease to function. It could be started again by raising the reservoir temperature above that prevailing in the heat pipe, in which case vapor would flow back into the pipe. Because a very small change in temperature suffices to produce a very large change in saturated vapor pressure, the switch between the on and off positions of the heat pipe is accomplished by very small changes in the reservoir temperature, with the result that it is essentially impossible to maintain the heat pipe in some intermediate stage of conductance. Significantly, Moore consistently refers to the "on" and "off" states of his device, although he claims that intermediate states are possible. Even in switching between these two states, there are inconveniences, if not problems. In order to make the switch, it is necessary for the control source that maintains the temperature of the reservoir either to absorb or deliver a rather large quantity of heat, namely the heat of vaporization of a significant fraction of the total inventory of the heat pipe. This in turn slows down the switching operation unless very large changes in the control temperature are employed. There can also be troublesome feedback from the heat pipe circuit: For example, if the pipe is turned off by making the reservoir pressure lower than the pipe pressure, and if the pipe load (i.e. passive thermal resistance through which the pipe current flows) is predominantly on the condenser end, then when the pipe heat current is shut off the condenser temperature, and hence the pressure in the pipe, will drop precipitously. Unless the reservoir has been driven to an even lower temperature and pressure, vapor will flow back into the pipe, turning it on again. Although the source temperature must be capable of large swings, its average value is about equal to the temperature prevailing in the heat pipe. Thus it would not be possible to use a low control temperature to control high-temperature heat flow. Moore did, in fact, describe a means whereby the average control temperature could be lowered, but this involved a second reservoir containing a different, more volatile fluid whose vapor pressure was to be used to control the pressure of the first reservoir, now enclosed in a bellows. This would introduce a fatigue-prone element, the bellows, without removing any of the problems except for the high average control temperature.

The Moore device is to be contrasted with my invention which involves a compact sealed device without any connecting reservoirs or any moving or fatigue-prone parts. The control temperature can be chosen to be any temperature below the operating temperature of the evaporator, and will operate well at temperatures well below that of the condenser, so that a low temperature can be used to control high-temperature heat flow. The quantity of heat that must be delivered or absorbed by the control source, both during steady-state operation and during a change in control temperature, is very small, so a low-conductance control source is feasible. This makes it possible to use the output of a low-power, low-temperature thermal amplifier (described below) as the control source for a high-power, high-temperature heat valve. There is very little internal feedback that would tend to make the effect of the control unpredictable, but it is easy to provide external feedback if desired, in a way that is completely analogous to what is done in vacuum tube and transistor circuits. Similarly, it is easy by external means to change the value of the control temperature that shuts off the heat pipe. Finally, unless external positive feedback is intentionally added in order to provide a sharp and sudden transition between the on and off states, it is very easy to maintain intermediate states of heat pipe conductance.

Because of the cascading that is made feasible by the characteristics of my device, it is possible to make very small changes in the temperature of a target or fin connected to the control grid of the first-stage amplifier cause a very large high-temperature heat valve to trigger on or off. This provides the means for servo-control of large-scale industrial processes that is powered by the same source that provides the heat for the process. It also provides the means for switching from a distance, since with sufficient amplification a light beam pulse focussed on the target that activates the first-stage amplifier can be made to open the large heat valve.

The availability of such controllable heat valves will make feasible the constant unattended accumulation and storage of solar energy (both on earth and in space) over long periods of time for use in short, high-power, high-temperature bursts of thermal energy. This capability would be useful for devices ranging from solar-powered cooking stoves to servo-controlled furnaces for materials processing in space. The use of valve-controlled heat reservoirs would also make the burning of fossil fuels more efficient because it would divorce the burning rate from the variable power demand. Thus the burner could be designed to burn steadily under its most efficient operating conditions at a rate that would suffice to satisfy the average, rather than the instantaneous, power demand.

SUMMARY OF THE INVENTION

The heat valves described below are modified heat pipes or heat siphons (which use gravity rather than the capillary action of a wick to return the condensate to the evaporator). For this reason, nearly all of the technology that is applicable to conventional heat pipes and heat siphons is also applicable to the heat valves described below. In particular, there is an extensive literature, and numerous patents, relating to the construction of evaporating and condensing wicks, and no claim of novelty regarding such wick construction is contained in the present invention. In the preferred embodiments below, wick structures that satisfy the imposed engineering requirements are illustrated, but these illustrations are not intended to imply that different wick structures that satisfy the same engineering constraints might not be more efficient. One explicit wick requirement is that the evaporating wick be able to hold at least twice as much liquid as the condensing wick. The reason for this requirement is to ensure that, if the polarity of the valve is reversed (i.e. the connections to heat source and heat sink are reversed), the valve will not conduct. This means that the valve acts like a one-way heat conductor, i.e. a diode. (This requirement of excess capacity for the evaporator wick is not necessary in the case of the falling-shower valve that is a modified heat siphon.) The concept of making a heat pipe uni-directional by giving the evaporator wick excess capacity was described in U.S. Pat. No. 3,587,725.

The controllable heat valve involves two major novel concepts, and several subsidiary ones. The two major concepts are the control grid and the liquid wick. In the case of the control grid, the liquid condensate is forced through a wire mesh or metallic diaphragm containing an array of uniformly-sized holes which converts the homogeneous liquid flow into a stream of droplets. The grid offers resistance to the fluid flow through it (aside from viscous drag) because the compressive energy of the fluid, i.e. its pressure, must be reduced by an amount that is sufficient to compensate for the surface energy of the newly-created droplets. If insufficient compressive energy is available to do this, the passage of the condensate through the grid will be blocked, and the heat valve will be shut off. The newly-created droplets will have the same temperature as that imposed on the grid, which is the control temperature, and because surface energy increases (almost linearly) with decreasing temperature, the fluid flow can always be blocked by reducing the control temperature to a sufficiently low value. Even when the fluid flow is not blocked, the magnitude of the pressure drop across the grid will increase as the control temperature decreases. Thus the pressure drop available to overcome viscosity in the rest of the fluid circuit is also reduced, with the result that the rate at which condensate is delivered to the evaporator is reduced, which causes a reduction in the effective thermal conductance of the heat valve. Thus the conductance has a nearly linear dependence on control temperature, decreasing when control temperature decreases.

When the heat valve is a modified heat siphon (which means that the heat flux is upward with respect to the earth's gravity and the condensate flow is downward), the newly-created droplets simply fall away from the control grid. This is called the "falling-shower valve". If the directions of heat and condensate flow are to be reversed, buoyancy will be required to move the droplets away from the control grid, and this implies the presence of a second fluid on the downstream side (i.e. the evaporator side) of the control grid. This second fluid (the valve fluid) should be immiscible with the working fluid and more dense than it in order to create the desired buoyancy. The valve fluid, together with the droplets of working fluid moving through it, is called the "liquid wick". Actually, it is not absolutely necessary (although desirable) that the condition on the relative densities of the two fluids be satisfied, because thermocapillary forces also tend to pull the droplets away from the control grid, and in most cases of practical importance (exceptions discussed below) the thermocapillary forces will predominate over buoyancy forces. This fact means that a liquid wick valve will function in the zero-gravity environment of outer space, whereas the falling-shower valve will not. The falling-shower valve will function, however, in connection with a rotating heat siphon in a zero-gravity environment, because centrifugal force can then be made to fill the role of gravity. Although the rotating falling-shower heat valve is not included among the preferred embodiments, it is to be understood that this would merely involve some geometric modification of the falling-shower heat valve designed for use in normal gravity.

The control grid can be constructed of commercially available wire mesh in the range of approximately 0.1–1.0 millimeter mesh size (the optimum size depending on design considerations). For the larger hole sizes punched plate would be an alternative. The mesh or plate must be a good thermal conductor, and must be of a material that is not wetted by the condensate fluid, or else it must have been surface-treated so that this requirement is fulfilled. In the case of the liquid-wick valve, it suffices if the grid is preferentially wetted by the valve fluid. If this requirement were not fulfilled, the condensate would leak through the holes of the grid and wet the entire downstream surface of the grid, and the temperature control over the condensate flow would be lost.

The grid is mechanically supported by a metallic framework that connects with a metal rod (the control rod) that penetrates the thermally insulating outer wall of the heat valve, and connects the external control source with the internal control grid. Unless the control source is immediately adjacent to the heat valve (which would not be the case in most applications), the time required for the heat valve to respond to changes in control source temperature can be enormously shortened by replacing the solid control rod and connecting support framework with a single long slender reversible heat pipe one end of which has the form of the grid support structure, while the other end connects with the control source. This control heat pipe must be capable of conducting heat in both directions, since it will be necessary both to warm up and to cool off the control grid in order to turn the valve on and off.

A subsidiary novel concept that is involved in the liquidwick valve is the "liquid bellows". This is constructed from a fine wire mesh that is preferentially wetted by the condensate fluid, and whose openings are small enough to prevent the interface between the condensate and the valve fluid from passing through it. This mesh is bent into the form of a corrugated "roof" that rests on top of the layer of valve fluid, with condensate lying above the valve fluid and penetrating the corrugated mesh. This corrugated mesh and the control grid bound and confine the valve fluid. However, it is necessary to allow the liquid wick to expand and contract in total volume according as the strength of the droplet flux increases or decreases. How the corrugated mesh accomplishes this is explained in detail below. Briefly, it forces the upper boundary of the liquid wick (i.e., the boundary farthest from the control grid) to assume a corrugated form in which the amplitude of the corrugation is variable and provides the necessary variation in volume. The corrugated interface between the liquid wick and the condensate fluid is the "liquid bellows".

The liquid-wick heat valve has coarse, thermally insulating wicks that separate the control grid and liquid wick from the evaporating and condensing wicks. The main function of these insulating wicks is to minimize the heat flux that must be absorbed by the control source in order to maintain the control grid at a temperature well below the condenser temperature. This heat current is the analog of the grid-leak current in the case of a vacuum tube, or the base current in the case of a transistor. (Such insulating wicks are unnecessary in the case of the falling shower valve, because the valve element is isolated on both sides by layers of vapor.) The insulating wicks also minimize the conduction heat leakage through the valve when it is in the off condition.

For the falling-shower valve and for the liquid-wick valve, two embodiments of each type are described below. One embodiment in each case corresponds to a power valve whose purpose is not only to control heat flow but also to serve as a coupler between two high-flux heat pipes. In order to maximize the contact surfaces witth such pipes, it is desirable to have them penetrate deep into the coupling heat valve, i.e. to design the valve around deep receiving sockets. The sockets and the ends of the heat pipes could be threaded, so as to allow good thermal contact and rigid mechanical union. In the case of low-power amplifier valves, however, the emphasis must be placed on convenience of incorporating them into thermal circuits that will provide the necessary biasing and feedback. In order to avoid long delay times, which would occur if thermal resistors in the form of rods were used in these circuits, it is necessary to use resistors in the form of very thin disks. By making the external evaporator and condenser surfaces of heat valve flat, it is possible to insert resistor disks between the ends of the heat pipe and the heat valve, and clamp them in place.

If the control rod (or heat pipe) of a power heat valve is not connected to a control source, but instead is insulated and allowed to "float", then the temperature of the control grid will be determined by the evaporator and condenser temperatures. If the cut-off temperature of the grid were designed to fall within the normal operating range of the heat valve instead of well below the normal condenser temperature, then the heat valve would function as a diode with an intrinsic turn-on temperature, which would be analogous to a gas diode in electronics whose turn-on voltage is an intrinsic atomic property of the gas. If, however, the control rod is connected to a variable temperature divider (a novel device described below), then the heat valve becomes a variable-bias diode whose turn-on temperature can be arbitrarily set by adjustment of the external temperature divider. The temperature can also serve as a manual switch for turning the heat valve on and off, or a manual means for adjusting the thermal conductance of the heat valve which is then functioning as a variable thermal resistor.

The basic thermal circuits that incorporate heat valves and are necessary for amplification and switching are discussed below.

BRIEF DESCRIPTION OF THE DRAWING

FIG. 3*a*: Cross-section of entire heat valve.

FIG. 3*b*: Section of condenser element.

FIG. 4*a*: Cross-section of entire heat valve.

FIG. 4*b*: Enlarged section of liquid-wick valve assembly.

FIG. 4*c*: Section of support for control grid.

FIGS. 6*a* and 6*b*: Temperature divider.

FIG. 6*a*: Exploded perspective view.

FIG. 6*b*: Detailed cross-section.

FIG. 10*a*: Relaxation oscillator.

FIG. 10*b*: Temperature regulator.

DETAILED DESCRIPTION OF THE PREFERRED EMBODIMENTS

FALLING-SHOWER HEAT VALVE

Figure 1:
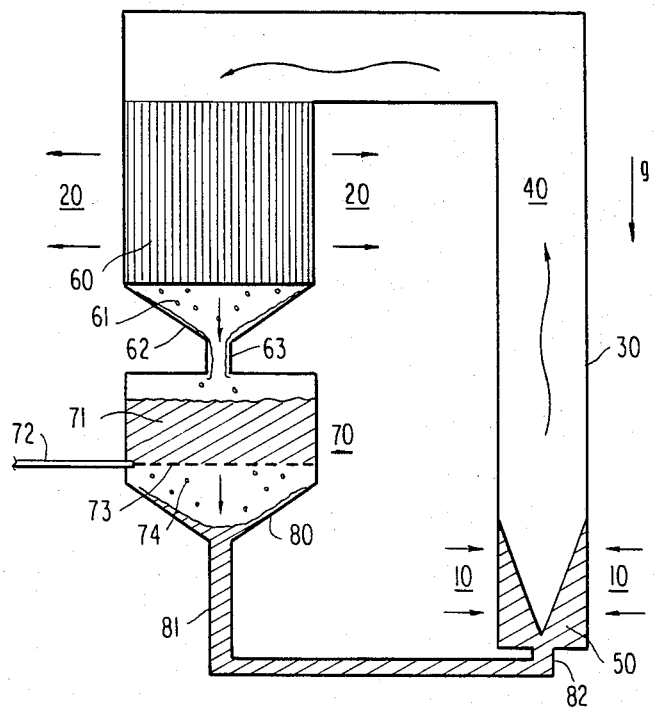
FIG. 1: Schematic of controllable heat siphon with separate evaporator, condenser, and valve assemblies.

The basic principles involved in a controllable heat siphon are illustrated in FIG. 1. A heat source 10 supplies heat to the saturated evaporator wick 50 and the resulting vapor travels up the vapor channel 40 that is enclosed by thermally insulating walls 30. The vapor is condensed in the condenser 60 which is a metallic honeycomb with vertical channels. The heat released by condensation passes into the heat sink 20, and the droplets of condensate fall into the funnel 62, and the condensate flows down the sloping sides of the funnel to the vertical pipe 63 that carries the condensate into the valve assembly 70 whose various parts are numbered 71 through 74. The control grid 73, which is connected to the control rod 72, supports the weight of a reservoir of condensate 71 whose head, however, creates suffcient pressure against the control grid 73 to cause the creation of a stream of droplets 74 that collects in the funnel 80. The collected condensate is then led back to the evaporator through the pipe 81, and enters the evaporator wick at the bottom through the orifice 82. The condensate is then drawn upward in the wick toward the evaporation front by means of the wick capillary action.

Cut-off occurs when the temperature of the control grid 73 is sufficiently low that the head of condensate in the reservoir 71 is unable to create sufficient pressure at the control grid to overcome the opposing force of the surface tension. When cut-off occurs, the evaporator wick dries out and the condenser drains so that essentially the entire inventory of working fluid (except for a small quantity trapped at the bottom of the return pipe 81) is in the valve reservoir 71 contributing to the cut-off head $h_{off}$ that tries to force the fluid through the openings of the control grid. If the width of these openings (or diameter, if they are round) is a, then to an accuracy that is sufficient for estimation purposes $$a=4\gamma(T_{off})/\rho\, gh_{off} \quad (1)$$

where $\rho$ is the density of the fluid, g is the acceleration of gravity, and $\gamma$ (T) is the known (nearly linear) dependence of the surface tension $\gamma$ on the temperature T of the surface. In the case of a mesh for which a=1 millimeter, $h_{off}$ would be about 3 centimeters in the case of water, 1 centimeter for mercury, and 8 centimeters for molten sodium.

Figure 2:
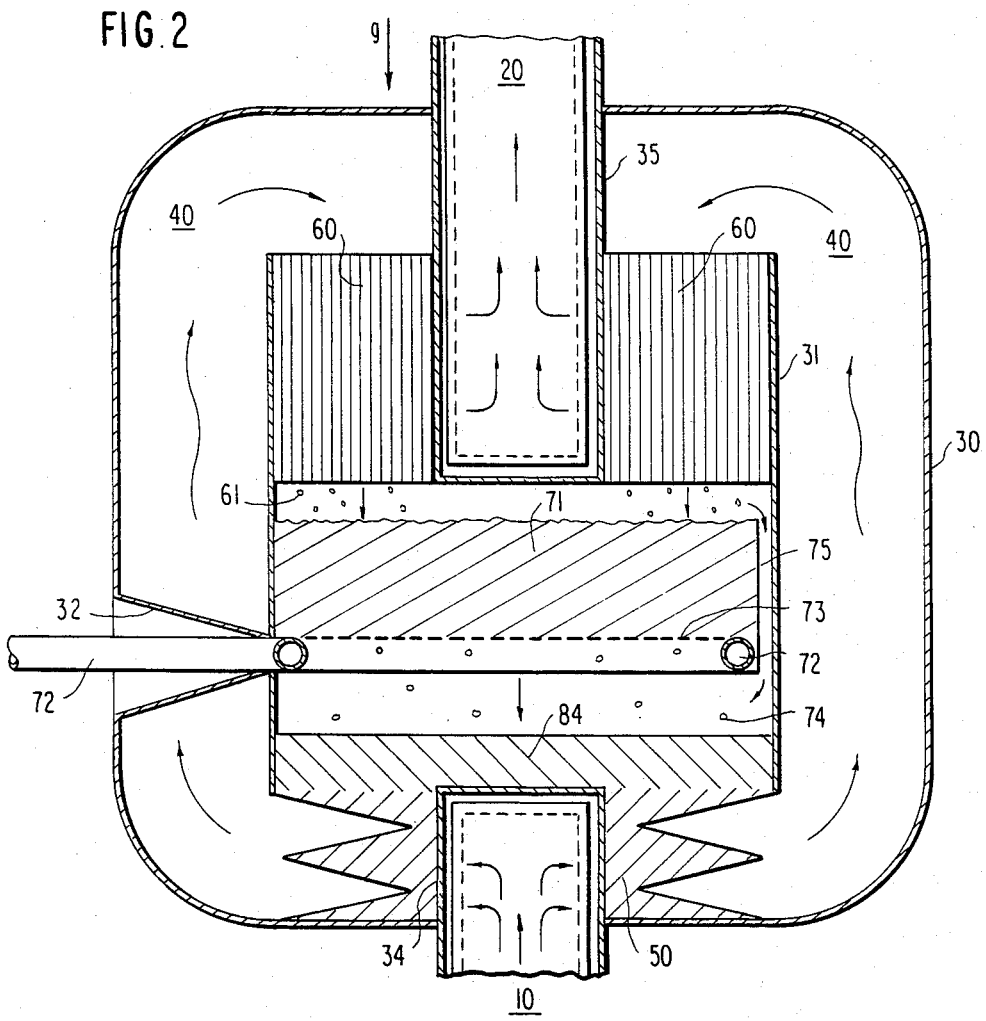
FIG. 2: Falling-shower heat valve as connector between two tubular heat pipes or heat siphons.
Figure 3A:
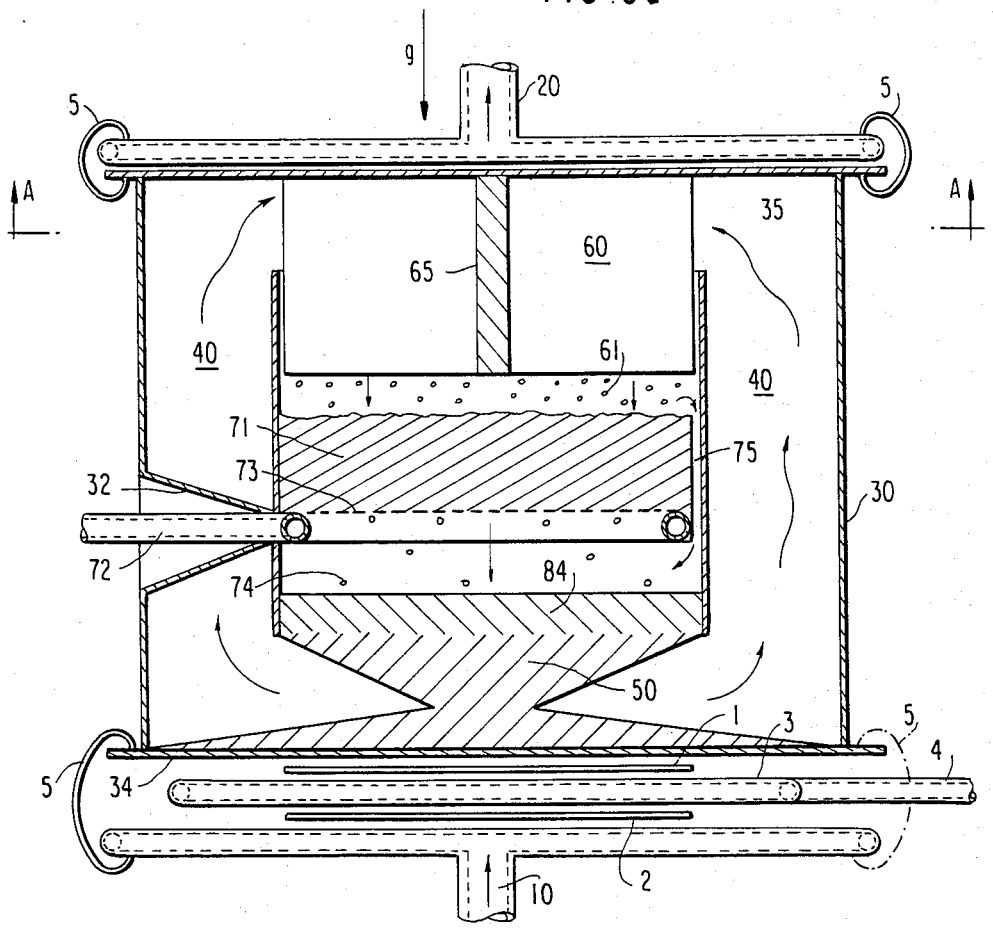
FIGS. 3*a* and 3*b*: Falling-shower heat valve with flat evaporator and condenser plates.
Figure 3B:
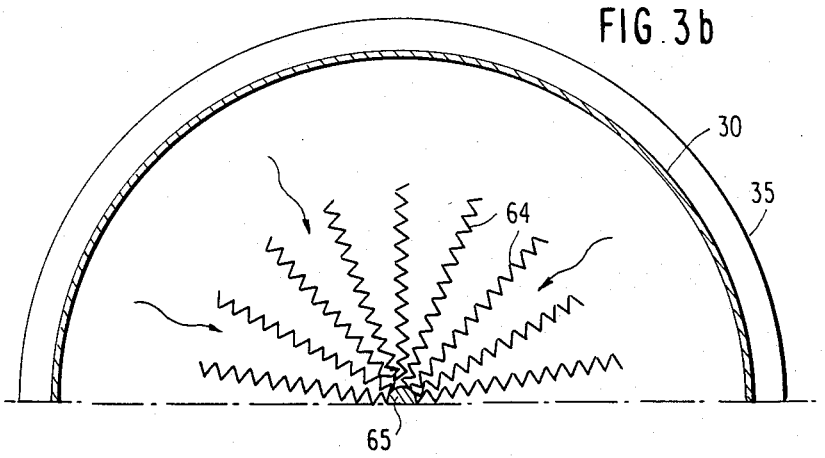

The configuration shown in FIG. 1 is characterized by the fact that the evaporator, condenser, and valve are all connected, but completely separate, units. Such a configuration would be feasible for the controlled upward transport of heat energy over large vertical distances. The preferred embodiments illustrated in FIGS. 2 and 3, however, combine all three units into a single compact unit called the "falling-shower heat valve" that connects two heat pipes, one serving as heat source, and the other as a heat sink. The preferred embodiment of FIG. 2 is intended to serve as a power valve that regulates a large heat flux passing between the two attached heat pipes. The labelling of the various parts corresponds to that of FIG. 1 with the exception that the condenser funnel 62 and connecting pipe 63 that are shown in FIG. 1 have been eliminated, and the valve funnel 80 and connecting pipe 81 in FIG. 1 have been replaced by the coarse insulating wick 84 of FIG. 2. The purpose of this wick, which should be coarse to minimize fluid resistance and made of material with low thermal conductivity, is to collect the falling drops of condensate and carry them to the evaporator wick 50, which is a good thermal conductor whose pore diameters are sufficiently small to provide for efficient distribution of the fluid throughout the wick. The insulator wick also prevents the vapor present in the space above it and below the control grid 73 from being heated by the evaporator wick so that this vapor remains at a temperature not much above that of the control grid. This minimizes the amount of heat that must be withdrawn by the control rod 72 (shown as a small heat pipe) in order to maintain the control grid at a temperature that will usually be well below the temperature of the condenser 60. By keeping the vapor below the control grid cold, its pressure will be kept low. If this pressure were allowed to rise to a value corresponding to a temperature closer to the evaporator temperature, it would act to prevent droplet formation at the control grid, making it necessary to maintain a much larger head of fluid in the valve reservoir 71. It would also make the flow of condensate through the control grid sensitive to changes in the evaporator temperature, whereas the ideal condition is that the condensate flow should depend solely on the grid temperature. During a long shut-off period the insulating wick 84 could dry out, leading to the gradual warm-up of the space between it and the control grid. In order to prevent such dry-out, a by-pass overflow 75 is provided in order to keep the insulating wick 84 partially wet even during a long period of shut-off. This also shortens the response time when the valve is turned back on again. Except for the overflow channel 75, the exiting control rod (heat pipe) 72, and the wall 32 that must be built into the exterior wall to allow the exit of the control rod and insulate it from the vapor channel 40, the entire heat valve structure is cylindrically symmetric about an axis coinciding with the axes of the heat pipes 10 and 20. In addition to the exterior insulating wall 30, the structure contains a cylindrical interior insulating wall 31 that insulates the condenser and valve units from the vapor stream. As noted above, the receiving sockets 34 and 35, into which the heat pipes 10 and 20 are inserted, and the ends of the heat pipes could be threaded so as to provide good thermal cpmtact amd rigid mechanical union, but for simplicity such threading has been omitted from the figure. The part of the control heat pipe 72 that lies beneath the control grid 73 and provides mechanical support for it is shown in FIG. 2 as a circular section of pipe connecting with the incoming straight section of control pipe. However, this circular support section of pipe could also have spoke sections as indicated in FIG. 4*c*. These spokes would provide more support, but more important than that would be the fact that they would make the temperature of the control grid more uniform, and would speed up the establishment of a new grid temperature following a change in the control source temperature. Without spokes, the non-uniformity in grid temperature would tend to "soften" the cut-off and turn-on of the heat valve.

Whereas a power valve is intended to transmit and control a very large heat flux, an amplifier valve is intended to receive an incoming signal consisting of a very weakly modulated temperature and deliver an output temperature that is much more strongly modulated. This output temperature can then be used as the control source for either a power valve or another amplifier valve to provide a second stage of amplification before activating a power valve. The smaller the heat flux that must pass through an amplifier valve in order to provide the desired degree of temperature amplification the better. Thus amplifier valves will be much smaller in thermal capacity and physical size than the power amplifiers which they are intended to control. An amplifier valve could be simply a scaled-down version of the heat valve pictured in FIG. 2, but the physical form of that design would make it difficult to incorporate the valve into the total thermal circuit that must be built around any amplifier valve. The reason for this has to do with the physical form that thermal resistors in amplifier circuits must assume if the response time of the amplifier is not to be unacceptably long. If such thermal resistors were in the form of rods, which could easily be inserted into the sockets 34 and 35 of FIG. 1, the time required for a temperature change to be transmitted along such a rod would be much too long. For example, for a copper rod only 10 centimeters long this transmittal time is of the order of a minute. Thus standard thermal resistors should be made in the form of very thin disks. In a typical thermal amplifier circuit, either the evaporator or condenser of the amplifier valve, or both of these, would have to be connected to a stack of several such resistors with temperature taps in between them. Such a tap should have the form of a thin conducting disk connected to a socket into which a long, thin heat pipe would be inserted, since such heat pipes would serve the role of connectors, just as copper wires serve this role in electrical circuits. Alternatively, the ends of such connector pipes could be made in the form of flat disk-like cavities. Thus the external evaporator and condenser surfaces of an amplifier valve should be flat as shown in FIG. 3 (which is cylindrically symmetric except for the same items that were mentioned in connection with FIG. 2. The various items of FIG. 3*a* are labelled in the same way as the corresponding items of FIG. 2. FIG. 3*a* contains several additional items in order to illustrate the above points concerning amplifier circuits. 1 and 2 are resistor disks, and 3 is the disk-like terminus of the heat pipe 4 that serves as a temperature tap between the resistors 1 and 2. These items are shown in an exploded representation for clarity. 5 illustrates the kind of springy C-clamp that could be snapped on at various points around the periphery in order to clamp all the items together. Within the heat valve, the most significant difference (aside from the flat ends) compared with the valve of FIG. 2 is in the condenser 60. Instead of the honeycomb of vertical tubes illustrated in FIG. 2, the condenser of FIG. 3*a* is made of an array of vertically corrugated metal fins 64 which is illustrated in the horizontal section A—A shown in FIG. 3*b*. These plates are attached to, and radiate from, a central metallic pillar 65 made of a good thermal conductor. This piller and all of the corrugated fins are welded or brazed to the top endcover 35 of the heat valve. The corrugations in the fins not only present more cooling surface to the oncoming vapor, but also speed up the downward flow of the condensate which concentrates in the convex channels, thereby forming a deeper boundary layer having less viscous drags than would be the case on a flat surface. A vertical honeycomb like that shown in FIG. 2 would not be appropriate for the flat-ended device pictured in FIG. 3*a* because the vapor must enter from the sides instead of from the top. The form of the evaporator wick 50 is also different from the one illustrated in FIG. 2 to allow for the different heat flow pattern.

The flat-ended heat valve would be a suitable design for a power valve as well as an amplifier valve if high-capacity heat pipes were fabricated in the "nail-head" illustrated by 10 and 20 of FIG. 3*a*. This form would have the added advantage that two such heat pipes could be butted together end-to-end and clamped together to form an extended heat pipe, and the junction would have far less thermal resistance than any junction formed by clamping together two tubular heat pipes would have.

If either of the falling-shower heat valves pictured in FIGS. 2 and 3 were accidentally turned upside-down, most of the condensate would drain from the reservoir 17 through the condenser 60, into the vapor channel 40. Upon uprighting the valve, the condensate in the vapor channel would fall toward and be absorbed into the evaporator wick 50 where it would be vaporized and travel to the condenser 60 in the normal fashion, so the valve would automatically restart itself.

THE LIQUID WICK

If the heat is to flow in the downward direction through a heat valve, then the return flow of condensate must be upward, so it is necessary to interpose just downstream of the control grid a layer of a second fluid, the "valve fluid", that is more dense than the condensate and immiscible with it. Then the droplets of condensate that are formed at the control grid will "fall upward" because of buoyancy forces. The valve fluid must also have a considerably higher boiling point (i.e. much lower vapor pressure) than the condensate so that there is no chance that a layer of valve fluid vapor could form within the liquid wick. The layer of valve fluid with droplets of condensate moving through it constitutes the "liquid wick". The liquid wick is shown in cross-section in FIG. 4*a*, and in an enlarged version in FIG. 4*b*. The liquid wick 76 lies above the control grid 73, and the droplets 74 move upward through it. Condensate 71 lies below the control grid 73, and in the region 81 above the interfacial boundary 80 of the two fluids, so that the liquid wick is confined to the region 76. The temperature increases in the direction from the control grid 73 toward the interfacial boundary 80, and it is well known that, even in the absence of buoyancy forces, immiscible droplets situated in a host fluid in which a spatial variation in temperature exists tend to migrate toward the warmer regions of the host fluid. This phenomenon, called thermocapillary migration, is a direct consequence of the temperature dependence of the energy associated with the interface between the droplet and the surrounding host fluid. This interfacial energy, just like the surface energy between a liquid and its vapor (i.e. the surface tension), decreases with increasing temperature. Thus, by moving into a warmer region of the host fluid, the droplet is decreasing its total ordered energy, and this decrease in interfacial energy is what powers the droplet migration against viscous drag. For this reason a liquid wick will transport condensate fluid toward the evaporator end of the heat valve even in the zero-gravity environment of outer space. (cf. Ref. 2).

The analysis of the combined effect of both gravity and a temperature gradient on an immiscible droplet in a host fluid shows that the thermal part of the migration velocity is proportional to the product of the droplet diameter, the magnitude of the temperature gradient, and the magnitude of the derivative of the interfacial energy with respect to temperature. The gravitational (i.e. buoyancy) part of the migration velocity is proportional to the product of the square of the droplet diameter, the density difference of the two fluids, and the acceleration of gravity g. Both velocity contributions also depend on the viscosities of both fluids, being smaller the greater the viscosities. In fact, an examination of the material properties of various fluids shows that the viscosity is the most variable property, so if large migration velocities are desired, it is important to choose inviscid fluids. The fact that the thermal part of the velocity depends on the droplet diameter, whereas the gravitational part depends on the square of the diameter, means that for small droplets (less than about 0.1 millimeter) the thermal part usually dominates, and this has been demonstrated experimentally. (Cf. Ref. 3.) Thus, for the liquid wick pictured in FIG. 4*b*, even if the host fluid were slightly less dense than the droplet fluid, if the droplets were sufficiently small and the temperature gradient sufficiently large, they would nevertheless rise, in defiance of gravity. However, this depends on maintaining a sufficiently large temperature gradient, a condition that may not be fulfilled under all operating conditions, so for a heat valve to be used on earth it is safer to require that the wick fluid be more dense than the condensate. For applications in zero-gravity, however, the requirement on wick fluid density can be ignored altogether.

There are certain fluids, notably water and mercury, for which thermocapillary migration does not occur. (Cf. Ref. 4.) The reason for this is that these fluids are very subject to contamination by surfactant impurities which are drawn to the droplet interfaces and nullify the thermocapillary effect. This is not true, however, for most organic liquids and molten metals, and so these would be candidates for use in heat valves intended for zero-gravity applications. Even water and mercury could be used in earth-bound heat valves of the liquid-wick type because the migration through the liquid wick would be caused by buoyancy. They could also, of course, be used in the falling-shower type of heat valve which depends only on the temperature dependence of surface tension, but on thermocapillary migration. Surfactant contamination can cause a lowering of the surface tension, and with it a lowering of the cut-off temperature of the control grid, but it cannot nullify the action of the falling-shower valve altogether.

Although measured values for the interfacial tension for various pairs of organic liquids are available (Refs. 5 and 6) for liquid wick design, very few measurements have yet been made for pairs of molten metals. However, there are three very promising candidates for possible use as wick fluids in connection with sodium (the workhorse of high-temperature conventional heat pipes) as droplet fluid. They are aluminum, zinc, and magnesium. All three are more dense than sodium, have much higher boiling points than sodium, and are immiscible with it when both are molten. (Cf. Ref. 7.)

Figure 4A:
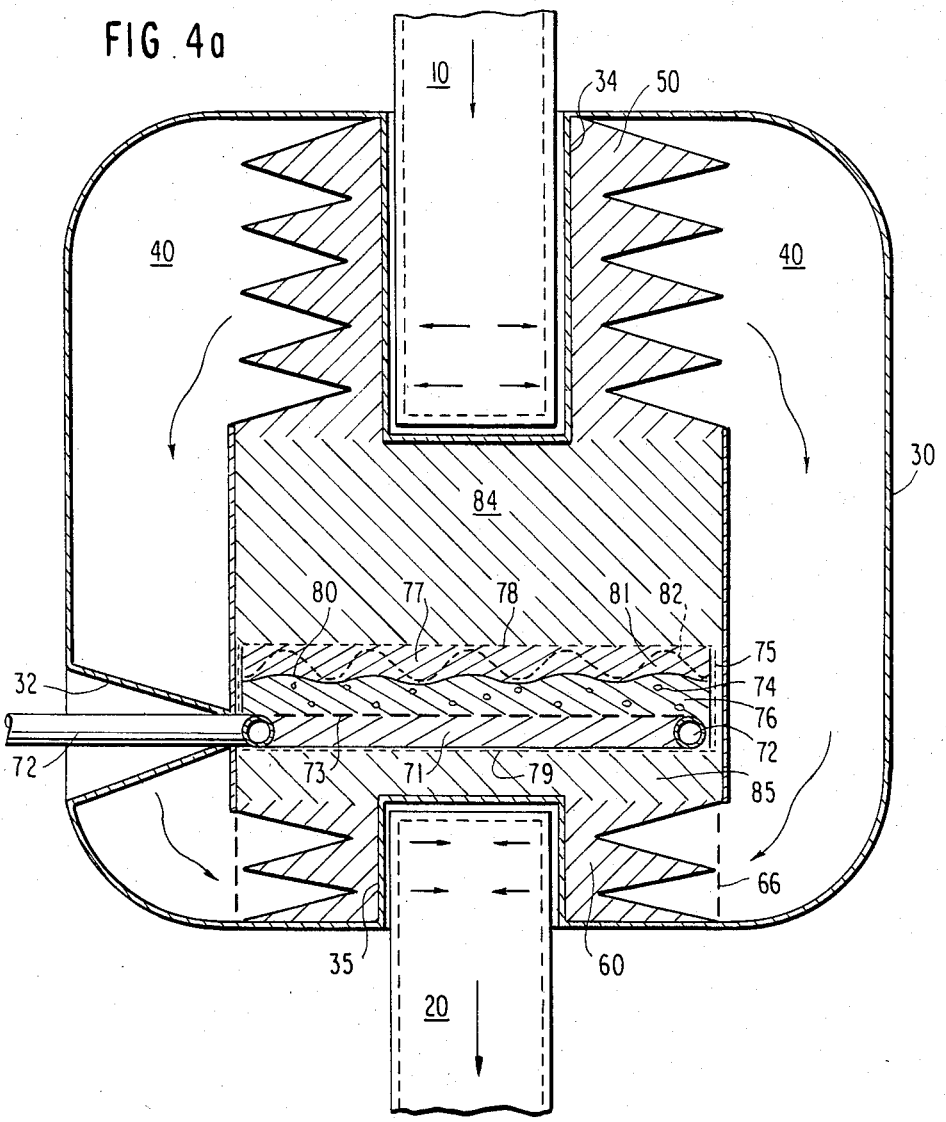
FIGS. 4*a*, 4*b*, and 4*c*: Liquid-wick heat valve as connector between two tubular heat pipes.

Estimates indicate that for a heat valve of the kind pictured in FIG. 4*a* a droplet diameter of about 0.1 millimeter would be a convenient size both for pairs of organic liquids and pairs of molten metals. In the organic liquid case droplet velocites that are very roughly of the order of 0.1 millimeter/second can be expected, whereas in the case of molten metal heat valves the expected velocity would be about 1 millimeter/second. Since the liquid wick pictured in FIG. 4*a* would be only several millimeters thick, the droplet transit times would be of the same order of magnitude as the time required to impose a temperature change on the control grid. In actual fact, however, the droplet transit time is not of much relevance to the performance of the heat valve because, once the droplets are formed at the control grid, all of them will transit the liquid wick regardless of speed, which only influences the spatial density of the droplets. In other words, the flow rate of condensate through the liquid wick is determined solely by the production rate of droplets at the control grid. Because the evaporation front in the evaporator wick is connected to the control grid by an uninterrupted column of incompressible fluid, any change in the production rate of droplets at the control grid is immediately felt at the evaporation front, which advances or recedes accordingly. Thus the characteristics that determine the response time of the heat valve are thermal inertial in the control grid and its immediate neighborhood, and the resistance to advance and recession of the evaporation front. The first of these depends on the conductivity and heat capacity of the control grid and the two fluids in contact with it. The second depends on the geometry of the evaporator wick and its conductivity, permeability, and capillary pulling power.

Although the valve fluid and the working fluid are chosen to be immiscible in each other, some mutual temperature-dependent solubility is always present. In fact, the temperature dependence of the solubility and the temperature dependence of the interfacial tension are closely related, and when the former is extremely small so is the latter. Because of mutual solubility, the droplets will absorb a small amount of valve fluid in transit through the liquid wick, and when the working fluid is vaporized in the evaporator wick, the dissolved valve fluid will be left in solution because of fractional distillation. The cumulative effect of this will be that there is a gradient in concentration of dissolved valve fluid that increases as the evaporation front is approached. This concentration gradient will drive a diffusion of the dissolved valve fluid away from the evaporation front, so that a condition of dynamic equilibrium will be established in which the diffusion runs upstream against the oncoming flow of condensate and maintains the magnitude of the concentration gradient that drives the diffusion. The presence of the dissolved valve fluid raises the boiling point of the condensate, so that the condensate must penetrate to a hotter part of the evaporator wick before it is vaporized. The more solute, the higher the boiling point, so vaporization will occur over a small range of temperatures rather than at a single temperature, and this will make for more efficient use of the evaporator wick. Diffusion will carry the dissolved valve fluid back to the liquid wick, so that when the dynamic equilibrium becomes established, the liquid wick receives by diffusion an influx of valve fluid molecules that equals the valve fluid that enters into solution in the transiting droplets.

THE LIQUID BELLOWS

The droplets of condensate that transit the liquid wick enter the insulating wick 84 (FIG. 4*a*), and are drawn by capillary action into the evaporator wick 50 where the condensate fluid is vaporized. If the liquid wick 76 were directly bounded by the insulating wick 84 then, whenever the control grid temperature was raised and the droplet flux in the liquid wick increased, the total volume of the liquid wick would also increase, because both the droplets and the valve fluid are incompressible. This would force the valve fluid into the insulating wick 84 until a subsequent decrease in droplet flux allowed it to retreat from the wick. Even if the insulating wick were preferentially wetted by the condensate rather than the valve fluid, some of the valve fluid would inevitably be trapped in the pores of the insulating wick. In time this could lead to sufficient transfer of valve fluid from the liquid wick to the insulating wick so that the controlling action of the control grid would be lost. Thus it is preferable to separate the liquid wick 76 from the insulating wick 84 in a way that still permits free passage of condensate into the insulating wick, and also allows for the volume changes in the liquid wick that accompany changes in droplet flux. These requirements are fulfilled by the "liquid bellows" which consists of parts 80 through 83 shown in enlargement of FIG. 4*b*. The essential feature of the liquid bellows is the wavy interface between the liquid wick 76 and the condensate 81. This wavy interface constitutes the evaporator-side boundary of the liquid wick (the condensor side being bounded by the control grid 73). An increase in the total volume of the liquid wick 76 is accompanied by an increase in the amplitude of the waviness of the interface 80. Thus the interface constitutes an expandable corrugated "lid" for the liquid wick. The corrugations in the interface 80 are caused by corrugations in a fine wire mesh 82 that is preferentially wetted by the condensate, and whose openings are sufficiently small that the interface 80 between the valve fluid and the condensate 81 will never be able to penetrate the mesh under any conceivable operating condition. The corrugated mesh is positioned so that the lower tips of the corrugation rest on the interface 80. When there are no droplets in the liquid wick, this interface will be flat. When droplets are admitted and the total volume of the liquid wick increases, the boundary 80 will be forced to assume the wavy form pictured in FIG. 4*b*, with the low points of the waviness "anchored" to the lower tips of the fine mesh, which the interface cannot penetrate. The greater the instantaneous quantity of droplet fluid in the liquid wick, the greater the curvature of the waviness. The limiting condition, that would correspond to the maximum permissible total volume of the liquid wick, occurs when the interface 80 coincides with the corrugated mesh 82. The wire mesh 83 is made of much stiffer, coarser wire, and provides mechanical support for the very fine mesh 82.

THE LIQUID-WICK VALVE ASSEMBLY

Figure 4B:
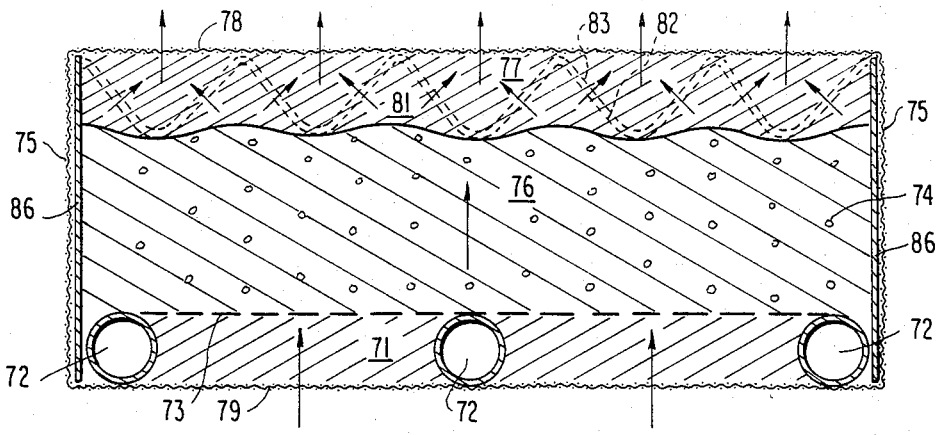
Figure 4C:
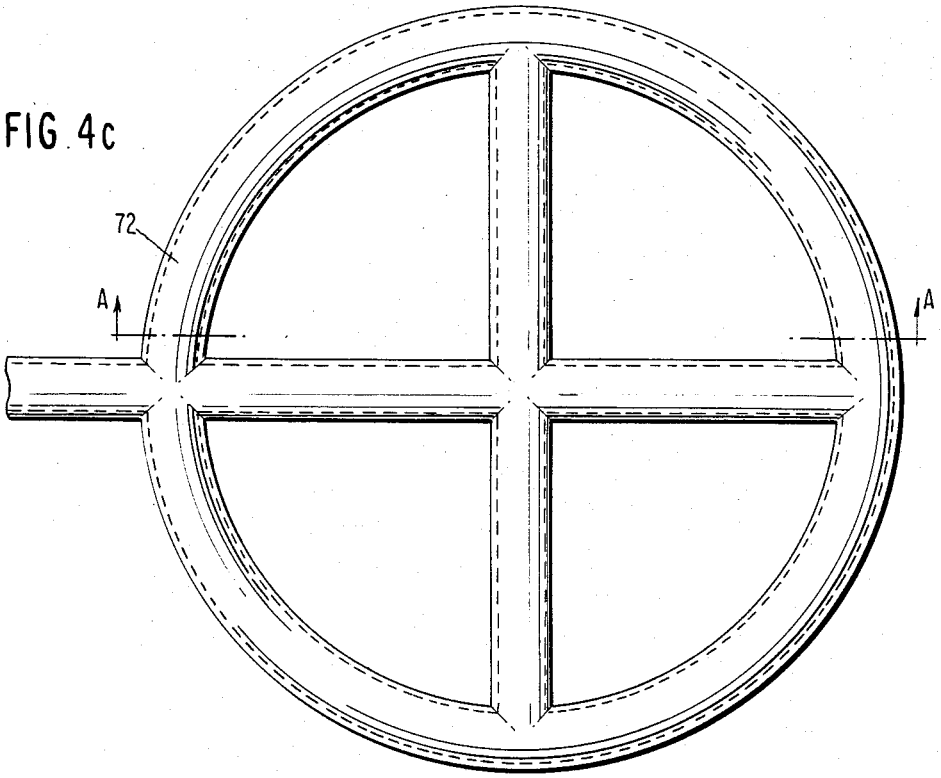

The liquid-wick valve assembly is pictured in cross-section in FIG. 4*b*. It is enclosed in a cylindrical container 86 with open ends. Across these open ends are stretched fine wire meshes 78 and 79 that are made of the same mesh material as 82. This same mesh material 75 also covers the outside of the cylindrical container 86. All of these meshes, like the liquid bellows mesh 82, must be preferentially wetted by the condensate fluid, and must have openings that are small enough so that, if the interface between the valve fluid and the condensate were ever to arrive at either of the meshes 78 or 79, it could not penetrate. This guarantees that whatever happens, the valve fluid will be contained within then cylindrical valve assembly, and will not be allowed to enter into either of the insulating wicks 84 and 85 pictured in FIG. 4*a*. For most pairs of fluids, the interfacial tension between the two liquids is less than the surface tension of either of them against its own vapor (or in air). (Cf. Ref. 4.) Thus if the openings of the meshes 78 or 79 are small enough to prevent the penetration of the interface, they will also prevent the escape of the condensate in the region 71 below the control grid and in the region 77 above the liquid bellows when, during fabrication, the entire valve assembly is in air outside the total heat valve structure. This would allow the pre-fabrication of the valve assembly, and its subsequent insertion as a unit into the total heat valve structure. The spoked heat pipe structure 72 that supports the control grid 73 and serves as the terminus of the control heat pipe is pictured in cross-section in FIG. 4*c*. The mesh 75 that surrounds the outside of the cylindrical container 86 serves as a bypass path for condensate so that, even when the droplet flux is cut off, there will remain a small leakage current of condensate that is constantly supplied to the evaporator wick. The reason for this will be explained below. It is desirable that the cylindrical container 86 be a poor thermal conductor so as to provide extra thermal insulation (in addition to that provided by the interior wall 31 shown in FIG. 4*a*) between the vapor channel and the valve assembly. It is also desirable (but not critical) that the interior surface of the container 86 be preferentially wetted by the valve so that there will be no tendency for droplets to cling to the wall of the liquid wick region 76. It is critical and necessary, however, that the control grid (especially its downstream face that abuts against the valve fluid) be preferentially wetted by the valve fluid in order to prevent the droplet material from wetting the entire downstream face of the control grid, which would cause the loss of its control function.

THE LIQUID-WICK HEAT VALVE

The liquid-wick heat valve is pictured in FIG. 4*a*. Heat is transported downward from the source heat pipe 10 to the sink heat pipe 20. Because this heat valve is not dependent upon gravity for its functioning, the direction of the gravitational force has not been indicated in the figure. The evaporator wick 50 should have at least twice the fluid-holding capacity of the condenser wick 60. This guarantees that, if the polarity of the heat valve were reversed by making 10 the sink and 20 the source, the heat valve would not conduct heat by means of the vaporization-condensation process, but rather only by thermal conduction through its various parts. (Cf. U.S. Pat. No. 3,587,725.) More exactly stated, the capacity of the wick 50 should be large enough so that if this wick were called upon to function as the condenser wick, it would remain unsaturated up to the point that the wick 60 went dry and ceased to deliver more vapor to the wick 50. This means that 50 would continue to exert its full capillary pulling power on the control grid 73, and this would counteract the pulling power of the wick 60 which would now be playing the role of evaporator. More exactly stated, because the evaporation front would be in the insulating wick 85 if the wick 60 is dry, it would be the pulling power of the wick 85 that would be counteracted by the pulling power of the wick 50. It is desirable to make 85 a very coarse wick for two reasons: First, this increases its permeability and reduces its resistance to fluid flow. Second, it reduces its capillary pulling power making it less than that of the wick 50. Doing this guarantees that, even if the polarity of the valve is reversed, the valve fluid will remain in the region 76, rather than be pulled through the control grid 73 into the region 71. Even if this were to happen, the valve fluid could not get past the fine mesh 79. If the wick 85 were to become completely dry, the valve fluid could still not get past the mesh 79, because then it would be stopped by its own surface tension, rather than by the weaker interfacial tension. The mesh 79 should be fine enough so that, even if the wick 50 should become saturated so that is lost its pulling power (because its pore meniscus became flat instead of concave), the valve fluid would still not be able to penetrate 79. Thus it would be guaranteed that under every contingency the valve fluid would remain within the valve assembly, which in turn guarantees that when normal polarity is again restored, the valve assembly will automatically be restored to its normal operating condition.

The purpose of the insulating wicks 84 and 85 is to provide thermal insulation between the control grid 73 and the source pipe 10 and the sink pipe 20 so as to minimize the heat current that must be supplied or absorbed by the control source in order to maintain the control grid at a temperature that is very different from the evaporator and condenser temperatures. Because a heat valve will usually be designed so that the control temperature is well below the normal operating temperature of the condenser, and hence even further below that of the evaporator, it will normally be desirable to make the wick 84 thicker than the wick 85 in order to provide more insulation. If the working fluid is a good thermal conductor such as a molten metal, then it would be desirable to make the fluid-holding capacity of the insulation wicks 84 and 85 small, which is possible even in a coarse wick since the two requirements can be satisfied by a wick that has has a relatively small number of coarse channels through an insulating solid. This could be achieved with a densely packed bed of spherical glass or ceramic beads.

If the insulating wick 84 is considerably coarser than the evaporator wick 50 (which, like the condenser wick 60, should be a good thermal conductor), then the capillary pulling power of the wick 84 would be considerably less than that of the evaporator wick 50. This fact could produce an unacceptably large hysteresis in the control characteristics of the heat valve in the sense that the turn-on temperature of the control grid would be very much warmer than the turn-off temperature. The reason for this is that in turning off the heat valve it is necessary to make the interfacial temperature at the control grid cold enough to oppose the strong pulling power of the evaporator wick 50. When this is done, the supply of fresh condensate to the evaporator is cut off and the evaporation front recedes into the insulation wick 84 which has considerably less pulling power. Thus it will be necessary to raise the control grid to a considerably higher temperature in order to allow droplets to form again, thus turning the valve back on. If, however, a sufficient leakage supply of condensate constantly arrives at the evaporator in order to keep the evaporation front from receding into the insulating wick 84, then the hysteresis is eliminated. If the source 10 were subject to large temperature excursions, then it would be desirable to match the pulling power of the insulating wick 84 to that of the evaporator wick 50, even though this would decrease the permeability of 84. In this case, the leakage current would not be necessary in order to prevent hysteresis. The leakage would, nevertheless, be desirable for a different reason. Without it, during long periods of shut-off, the evaporation front will retreat deep into the insulating wick 84. Thus, when the condensate current is turned back on again, a considerable time will be required for the condensate to climb back up through 84 into the evaporator wick 50. Only when this happens will the valve start transferring heat again. For this reason, the response time of the valve can be considerably shortened by supplying a large enough leakage current of condensate to keep the evaporation front either in the evaporator wick 50, or just below it near the top of the insulating wick 84. Note that if an extreme rise in evaporator temperature should occur during a time when the droplet flux was cut off, so that the evaporation front receded all the way to the bottom of the insulating wick 84, then the fine mesh 78 would provide an added measure of protection against damage. The reason for this is that the mesh 78 is much finer than the insulating wick 84, so its pulling power is much greater. Thus the arrival of the evaporation front at the mesh 78 would result in a sudden increase in the pull exerted on the interface at the control grid, which would cause the droplet flux to start again, thus preventing the evaporation front from advancing into the valve assembly.

A small amount of hysteresis will nearly always be present, even if the evaporation front always remains in the evaporator wick 50, because of the difference in capillary pulling power that exists between a falling and a rising fluid level in a wick. This difference, however, is small, and will cause a correspondingly small difference in the turn-off and turn-on temperatures of the control grid. This small amount of hysteresis is, in fact, usually desirable, because it provides a degree of stability to the switching operation and prevents the valve from turning on and off in response to small fluctuations in the control temperature about the cut-off value.

The coarse cylindrical mesh 66 that envelops the condenser grid 60 is useful in the case of a heat valve operating in the weightless environment of outer space. During periods of cut-off, liquid condensate accumulates at the condenser end of the vapor channel 40. In a zero-gravity environment, slight jostling of the valve would cause this condensate to slosh about in the vapor channel, and some of it would arrive at the evaporator 50 and be vaporized. Thus the value would transfer heat in a sporadic fashion in response to slight jostling. The purpose of the coarse mesh 66, which would not impede vapor flow to the condenser 60 during the on condition of the valve, is to "capture" the liquid condensate that accumulates during cut-off, and confine it to the condenser vapor channels within the condenser wick.

The heat valve pictured in FIG. 4*a* is basically a heat pipe to which a valve assembly has been added. For this reason, all of the normal considerations and criteria that apply to the design of conventional heat pipes apply as well to the heat valve. There is, however, one extra important design parameter that refers specifically to the control grid, namely the width (or diameter) of its openings. To an accuracy that suffices for estimation purposes, the opening width a is given by $$a=4\gamma_i(T_{off})/\rho g(h_e-h) \quad (2)$$

where $\gamma_i(T)$ is the known functional dependence of the interfacial tension on temperature, $T_{off}$ is the cut-off temperature (ignoring hysteresis), $\rho$ is the density of the condensate, g is the acceleration of gravity, $h_e$ is the capillary lifting head of the evaporator wick in normal gravity, and h is the height of the column of condensate that must be supported during cut-off, which is approximately equal to the combined thicknesses of both insulating wicks 84 and 85, the valve assembly, and the insulator wick 60. The lifting head $h_e$ can be expressed in terms of the surface tension $\gamma$ of the working fluid and the effective pore diameter $d_e$ of the evaporator wick by the following relation:

$$h_e=4\gamma/\rho g d_e \quad (3)$$

where the temperature dependence of $\gamma$ can be neglected for estimation purposes. Eq. 2 is valid for a heat valve operating on earth. In zero-gravity, the capillary pulling power of the evaporator wick does not have to support the weight of the column of fluid of height h, so h can be dropped from eq. 2. Doing this, and substituting eq. 3into eq. 2 yields the relation for a zero-gravity environment:

$$a=d_e\gamma_i(T_{off})/\gamma. \quad (4)$$

Estimates indicate that for both organic fluids and molten metals, control grid openings of the order of 0.1 millimeters would be convenient and consistent with wicks (evaporator, condenser, and insulating) having effective pore diameters of the same order of magnitude.

Figure 5:
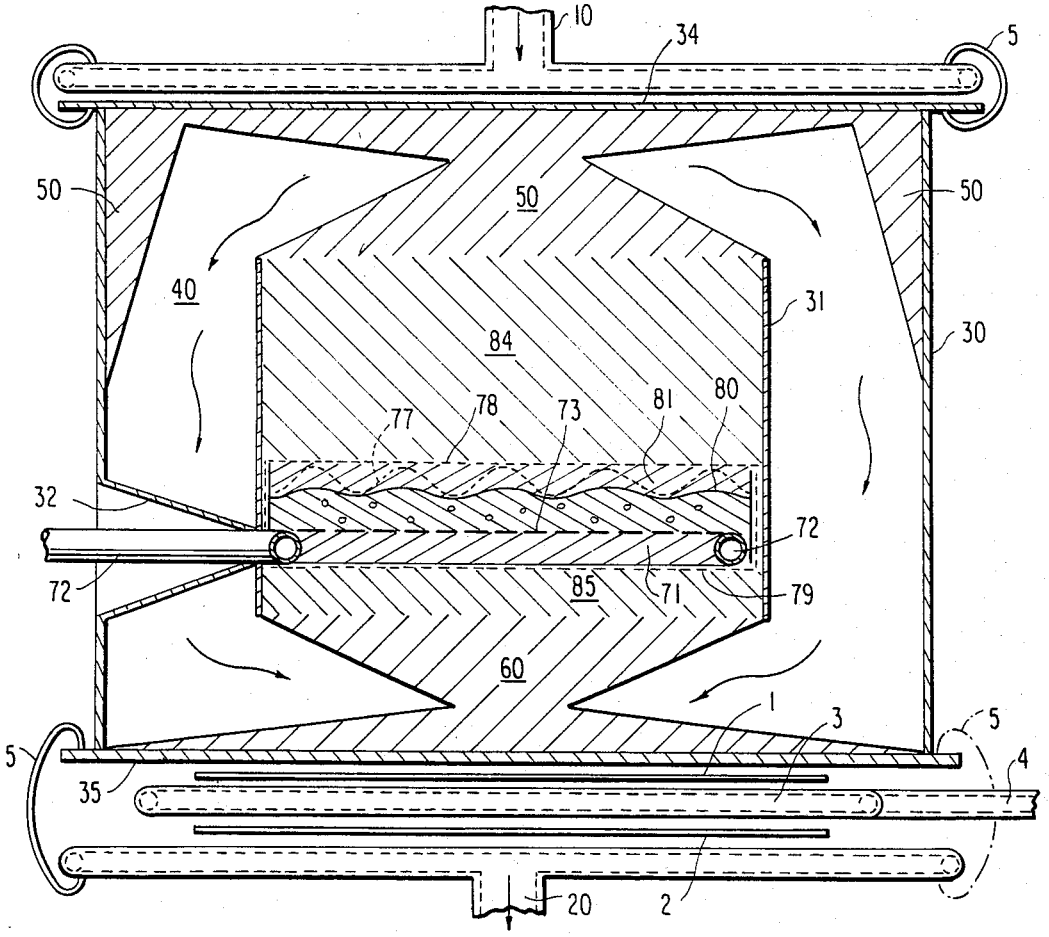
FIG. 5: Liquid-wick heat valve with flat evaporator and condenser plates.

FIG. 5 pictures the form of the liquid-wick heat valve that has flat evaporator and condenser surfaces. The various parts have functions and labels corresponding to those of FIG. 4*a*. In addition, two external resistors 1 and 2 and a tap 4 with disc-like terminus 3 are pictured connected to the condenser plate 35 by means of clamps 5. Except for the construction of the valve assembly and the condenser, and the fact that the heat flow is downward instead of upward, the heat valve pictured in FIG. 5 is similar to the falling-shower one pictured in FIG. 3*a*. One further difference results from the need to add excess capacity to the evaporator wick in the case of the liquid-wick valve shown in FIG. 5 in order to make it uni-directional, i.e. a diode. In order to make the valve more compact, the excess evaporator capacity has been added to the inside of the exterior insulating wall 30.

Although the preferred embodiment pictured in FIG. 5 has an annular vapor channel 40 surrounding the return condensate flow that rises through a central column at the core of the heat valve, the reverse is also possible. The same inventor has published a description of a liquid-wick heat valve with flat condenser and evaporator plates that has the vapor channel in the central core of the heat valve. (Cf. Ref. 8. )

THE TEMPERATURE DIVIDER

FIGS. 6*a* and 6*b* illustrate an auxilliary device, the temperature divider, that is necessary in order to exploit the full potential of either the falling-shower or the liquid-wick heat valve for the control of heat flow. This device is the analog of the voltage divider that is in common use in electrical circuits. The most common form of voltage divider consists of a high-resistance, tightly-wound coil of wire along with a sliding tap makes contact with a particular loop of the coil, depending on the manually selected position of the tap. When the two ends of the coil are connected to two different voltages, the voltage of the tap can be made to assume any value between these two. The same principle applies to the thermal analog, with thermal resistors replacing electrical ones. In the thermal case, however, much greater emphasis must be placed on keeping the thermal resistors thin (in the direction of heat current) in order to keep the response time of the device short. The temperature divider pictured in exploded perspective in FIG. 6*a* and in cross-section in FIG. 6*b* effectively uses a very thin layer of gas or liquid (108 in FIG. 6*b*) to play the role analogous to the high-resistance coil of wire in the voltage divider. Two flat, semi-circular heat pipe terminal 95 and 96 play roles analogous to connectors that connect the two ends of the voltage divider coil to the two voltage supplies. The role analogous to the sliding tap is played by a thin rotatable disk (97 and 98) mounted on a metallic hub 99 that rotates on a fixed axle consisting of a rigidly mounted heat pipe 93. Half of the rotatable disk (97) is made of a metal having high thermal conductivity. The other half (98) is made of a thermal insulator. When the metallic half of the rotatable disk is situated directly above the semi-circular heat pipe terminus 95, which is essentially isothermal, the metallic half 97 of the rotatable disk, as well as the hub 99 and the tap heat pipe 93, will all be at the temperature of the incoming heat pipe 94 that connects to the terminus 95. However, when the metallic half of the rotatable disk is situated above the semi-circular heat pipe terminus 94 that connects with the incoming heat pipe 92, then the temperature of the tap heat pipe 93 will be the same as that of the heat pipe 92. When the rotatable disk is positioned midway between these two extreme positions, the temperature of the tap heat pipe 93 will be midway between the temperatures of the two incoming heat pipes 91 and 92. Intermediate angular positions of the rotatable disk will result in correspondingly intermediate temperatures of the tap heat pipe 93.

The high thermal resistance of the gap 108 minimizes the heat flow between the pipes 91 and 92, in spite of the relatively low thermal resistance of the metallic semicircle 97. The thermal resistivity of the gas or liquid contained in the enclosing structure 90 (which should be made of a thermally insulating material) will determine the thermal resistance of the temperature divider, the magnitude of the heat current that must be supplied and absorbed by the temperature sources 91 and 92, and the magnitude of the heat current that can be supplied to or drawn from the tap 93. These same quantities are also influenced by the size of the gap 108. Thus the overall external dimensions of the temperature divider can be decided on the basis of convenience, because the thermal properties are determined by one critical internal dimension, the gap 108, and the conductivity of the liquid or gas in the container.

Although it would be possible to have the tap heat pipe 93 rigidly connected to the hub 99, this would require that the heat pipe 93 be capable of rotating with respect to the container 90, and this would require a rotating seal. It is very difficult to make a rotating seal that is sufficiently tight to prevent gas leakage over a long period of time, so rigid seals are to be preferred, and all three seals 94 are rigid. Such an arrangement, however, presents the problem of how to control the angular orientation of the rotatable disk from outside the sealed container 90. This is done by means of two magnets 100 and 101, one of which (100) is attached to the rim of the insulator half of the disk and follows the external magnet 101 that is mounted in such a way as to allow 360° rotation. One feasible arrangement for this is illustrated in cross-section in FIG. 6*b* (which also shows relative dimensions in truer proportion than the exploded view of FIG. 6*a*). The external magnet 101 is mounted on a rotatable annular disk 103 which fits into the annular groove 104 in the container 90. The annular disk 103 is moved manually by means of the knob 106. Instead of manual adjustment, it would be possible to move the disk 103 by means of an electrically-controllable servo-follower. Alternatively, the internal magnet 100 could be made to follow an externally generated rotatable magnetic field vector generated by adjustable currents in several different rigidly-mounted coils. This arrangement would have no external moving parts. In order not to interfere with the magnet control, the container 90 must be constructed of a non-magnetic material (that is also a thermal insulator, as noted above).

Several more details are illustrated in FIG. 6*b* that are omitted from FIG. 6*a*. There is a counterweight 102 (made of a thermal insulator) that is mounted on the metallic half of the rotatable internal disk in order offset the unbalancing effect of the magnet 100. The rotatable internal disk is supported and positioned by an annular fin 105 attached to the rigidly-mounted tap heat pipe 93. This fin fits into an annular groove in the hub 99. Convection currents in the region between the two semi-circular heat pipe termini 95 and 96 are suppressed by the insulating barrier 107. The three heat pipes 91, 92 and 93 emerging from the temperature divider are illustrated as being of the "nail head" variety so that they can easily be clamped to other similar heat pipes with the possibility of inserting disk-shaped thermal resistors and taps in between as illustrated in FIGS. 3*a* and 5.

THERMAL AMPLIFIERS AND SWITCHES

Figure 7:
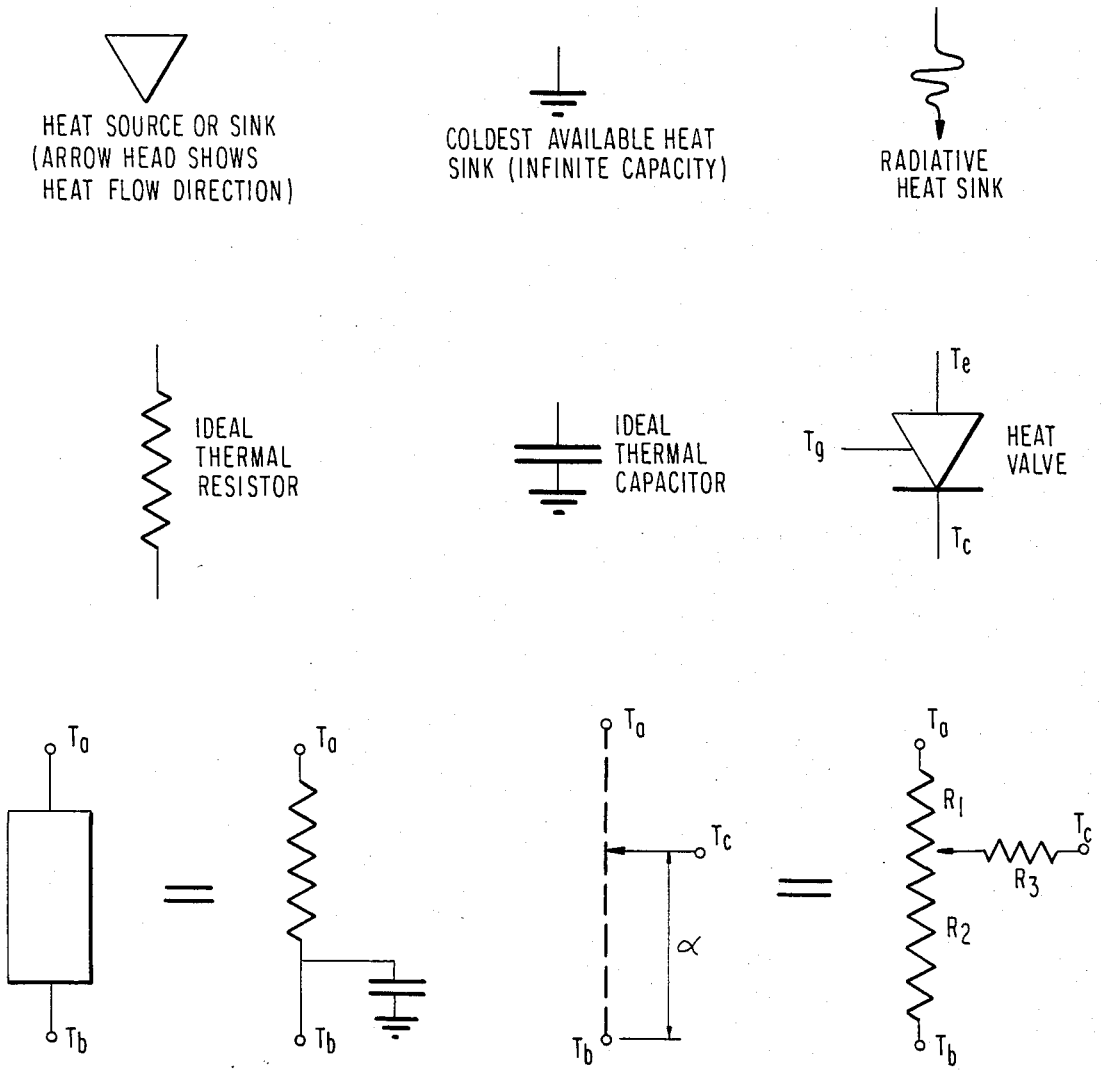
FIG. 7: Definitions of symbols used in FIGS. 8, 9 and 10.
Figure 8:
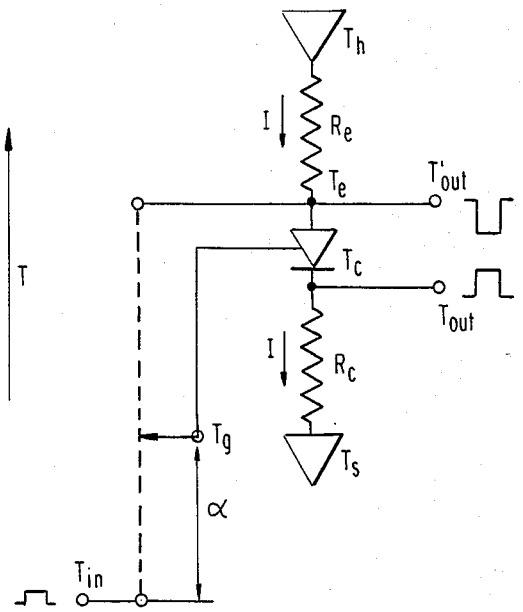
FIG. 8: Diagram of circuit for negative-feedback thermal amplifier.
Figure 9:
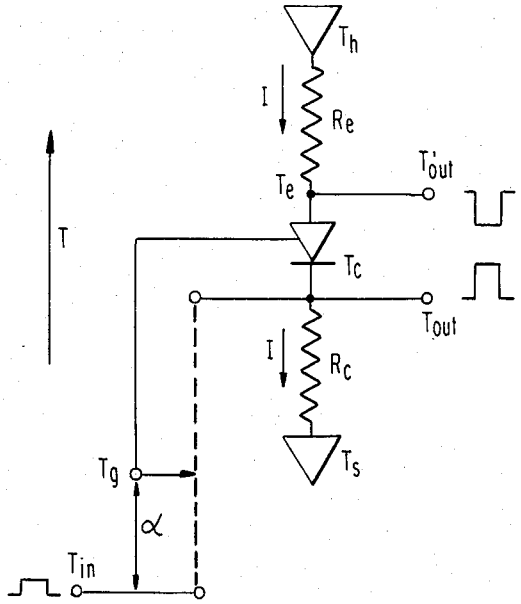
FIG. 9: Diagram of circuit for positive-feedback thermal amplifier.

Heat valves are regulated by a temperature, the control temperature, that must be provided by a source or sink external to the heat valve. A manually operated temperature divider could be used for this purpose with the divider tap connected to the control heat pipe of the heat valve. Alternatively, a temperature from some other point in the thermal circuit of which the heat valve is a part (the "signal temperature") could be used as the control temperature, thereby providing the circuit with feedback and self-regulation. However, in order to make the response of the heat valve sufficiently sensitive to small changes in the signal temperature, it might be necessary to amplify these small changes before using them as the control temperature of the heat valve. For this a thermal amplifier is necessary. If it is desired that changes in the conductance of the high-capacity heat valve (the "power valve") be proportional to changes in the signal temperature that is used for regulation, then a negative-feedback amplifier is appropriate, but if it is desired that a very small change in signal temperature suffice to turn the power valve completely on or off, then a positive-feedback amplifier, which would effectively function as a switch rather than an amplifier, would be appropriate. When a temperature from a previous stage of amplification or from some other point in the thermal circuit of a power valve is used as the control temperature of the power valve, it is frequently necessary to add or subtract a "bias temperature" to the signal temperature in order to bring it into appropriate relationship with respect to the cut-off temperature of the power valve. This shift in bias can be accomplished by means of a temperature divider. This and the basic features of negative and positive feedback amplifiers are illustrated in FIGS. 8, 9, and 10 which show thermal circuit diagrams using symbols that are defined in FIG. 7. FIGS. 8, 9, and 10 are drawn so that vertical position in each circuit diagram gives a qualitative measure of the relative temperatures of the various parts of the circuit, with temperature increasing in the upward direction. In every case the heat currents passing through the control grid circuit and through temperature dividers are neglected in comparison with the main current passing through the heat valve. Temperature dividers are indicated by a dashed line both to distinguish them from thermal resistors that carry the main current through the heat valve and to emphasize that the actual value of the resistance of the divider is not important so long as it is sufficiently high to make the current through it negligible compared with the main heat current I. The only important parameter in the case of a temperature divider is the position of its adjustable tap, which is indicated by $\alpha$ in FIGS. 8 and 9.

FIG. 8 illustrates the thermal circuit for a negative-feedback amplifier. In addition to the temperature divider, it contains two other resistors, one on the evaporator side of the valve having thermal resistance $R_e$, and one on the condenser side having resistance $R_c$. The hot end of the temperature divider is connected to a tap between the valve evaporator and the resistor $R_e$, and the cold end is connected to the input temperature $T_{in}$, which is the signal temperature that is to be amplified. The tap of the divider yields the temperature $T_g$ that controls the grid temperature of the valve. If $T_e$ is the external evaporator temperature of the valve, the grid temperature $T_g$ is given by $$T_g=(1-\alpha)T_{in}+\alpha T_e. \quad (5)$$

Thus the grid temperature is an adjustable weighted average of the evaporator temperature $T_e$ and the input temperature $T_{in}$, where the relative weight factors are determined by the divider tap position $\alpha$. (In terms of the equivalent circuit for the temperature divider shown in FIG. 7, $\alpha$ is given by $\alpha=R_2/(R_1+R_2)$.) Equation 5 shows that it is possible for $T_g$ to be considerably higher than $T_{in}$, and this would correspond to an upward shift in the grid bias, i.e., the cold signal temperature $T_{in}$ would be controlling a valve whose grid operated in a higher temperature range. This illustrates the use of a temperature divider to effect a shift in the grid bias of a heat valve.

The evaporator temperature $T_e$ depends on the valve current I according to the relation $$T_e=T_h-IR_e, \tag{6}$$

where $T_h$ is the temperature of the hot reservoir that powers the circuit. When $T_e$ from eq. 6 is substituted into eq. 5, it is evident that an increase in I causes a decrease in $T_g$, and this constitues negative feedback. Because the relation between the control grid temperature $T_g$ and the magnitude of the droplet flux (and hence the magnitude of the current I) is approximately linear, the following relation holds:

$$I=G_t(T_g-T_g^{co}), \tag{7}$$

where $T_g^{co}$ is the cut-off temperature of the grid, and $G_t$ is the transconductance of the heat valve, which is the basic performance parameter of the heat valve, and is approximately constant for a valve functioning as an amplifier. $G_t$ depends on the overall efficiency of the heat valve regarded as a heat pipe, as well as on the sensitivity of the return flow of condensate to changes in control grid temperature. If the evaporator temperature $T_e$ is used as the output of the amplifier so that $T_e=T_{out}'$, then the corresponding amplification factor A' can be calculated from eqs. 5–7, and is given by $$A'=(T_h-T_{out}')/(T_{in}-T_{in}^{co})=[(1-\alpha)R_eG_t]/[1+\alpha R_eG_t], \tag{8}$$

where $T_{in}^{co}$ is the input temperature that, by eq. 5, corresponds to the grid cut-off temperature $T_g^{co}$. The magnitude of $R_e$ will usually be chosen so that the condition $$\alpha R_eG_t>>1 \tag{9}$$

is satisfied. When this is the case, A' is, to a good approximation, given by $$A'\doteq(1-\alpha)/\alpha. \tag{10}$$

Thus, when the condition given by eq. 9 is satisfied, the amplification is entirely independent of the magnitude of $G_t$ (which can vary from valve to valve and can also change during the lifetime of a given valve), and depends only on the setting of the temperature divider. A comparison of eqs. 5 and 10 shows that the temperature divider can either be set to give a predetermined bias shift, or else to give a pre-determined amplification, but not both simultaneously (if $T_e$ is used as the output temperature). If both of these must meet pre-determined specifications, then two stages of amplification are necessary.

The evaporator temperature $T_e$, regarded as the output of the amplifier, has a very important characteristic, that of inverting the input signal. Thus a positive pulse in $T_{in}$ will produce a negative pulse in $T_e=T_{out}'$. These pulses are indicated beside the respective terminals in FIG. 8. This inversion can often be more important than amplification. For example, if a power valve is supplying heat to a passive load connected to its condenser end, and it is desired to hold the temperature of the load at some constant value despite losses due to radiation and conduction, then the load temperature could be used as the signal temperature, and a decrease in the signal temperature (a drop from the value at which the load is to be held ) should produce an increase in the grid temperature of the power valve in order to increase the rate at which heat is supplied to the load. Thus the signal must be inverted before it is fed into the grid of the power valve. It is also often the case that the load temperature is very much below that of the hot reservoir supplying it (as in the case of space heating by a furnace). In this case the signal temperature must not only be inverted, but also must be shifted to a much higher value before it can be used to control the grid of the power valve. If amplification of the signal is unnecessary, then the necessary requirements of inversion and bias shift could be fulfilled by the circuit illustrated in FIG. 8 with $T_e$ used as the output that is fed into the grid of the power valve.

If signal inversion is not desired, then the condenser temperature $T_c$ of the valve illustrated in FIG. 8 must be used as the output temperature $T_{out}$. In this case $$T_{out}=T_s+IR_c \tag{11}$$

and the corresponding amplification factor A is given by $$A=(T_{out}-T_s)/(T_{in}-T_{in}^{co})=(R_c/R_e)A'=[(1-\alpha)R_cG_t]/[1+\alpha R_eG_t]. \tag{12}$$

When the condition stated in eq. 9 is satisfied, A is given to a very good approximation by $$A\doteq[(1-\alpha)/\alpha](R_c/R_e). \tag{13}$$

In this case ($T_{out}=T_c$), $\alpha$ can be chosen to give a predetermined bias shift according to eq. 5, and $R_c$ can be choosen to give a pre-determined amplification according to eq. 13 ($R_e$ having already been specified by eq. 9), so both requirements can be satisfied with a single stage of amplification.

FIG. 9 illustrates the thermal circuit for a positive-feedback amplifier operating between the same two hot and cold temperatures $T_h$ and $T_c$. The only difference between it and the negative-feedback amplifier of FIG. 8 is that the hot end of the temperature divider is connected to the condenser end of the heat valve rather than to the evaporator end. In this case the grid temperature $T_g$ is given by $$T_g=(1-\alpha)T_{in}+\alpha(T_s+IR_c) \tag{14}$$

which shows that an increase in the valve current I produces an increase in $T_g$, which is positive feedback. The out-of-phase amplification factor A' is now given by $$A'=[(1-\alpha)R_eG_t]/[1-\alpha R_cG_t] \tag{15}$$

and the in-phase amplification factor A is given by $$A=(R_c/R_e)A'=[(1-\alpha)R_cG_t]/[1-\alpha R_cG_t]. \tag{16}$$

It is desired that these amplification factors be large so that very small values of $(T_{in}-T_{in}^{co})$ will produce very large output pulses that will suffice to change the grid temperature of a power valve from its cut-off value to a value large enough to produce maximum valve current (or vice versa in the case of inversion). Thus the amplifier functions as a sensitive switch. Large amplification results if $\alpha R_cG_t$ is nearly, but not quite, equal to 1. If $\alpha R_cG_t$ exceeds 1, the amplification factors become negative, which means that the amplifier is unstable and will begin spontaneously to oscillate, which could be useful for certain applications, but is to be rigorously avoided if the amplifier is to be used as a switch. The exact values of A and A' (which depend on $G_t$) are not important. All that is necessary for switching action is that they be as large as possible without producing instability, i.e., oscillation. In fulfilling this condition, the continuously variable feature of the temperature divider is useful, since, for given $R_c$ and $R_e$, $\alpha$ can be increased until the amplifier begins to oscillate, and then decreased slightly from the value that first causes oscillation, which is a simple way to optimize the effectiveness of the switching amplifier.

Figure 10A:
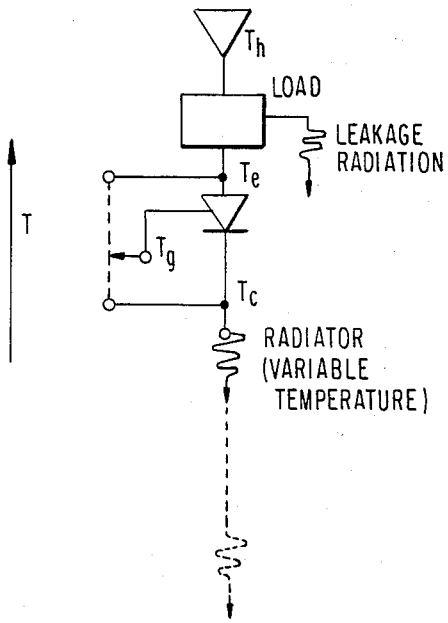
FIGS. 10*a* and 10*b*: Heat valve used as variable-bias diode.
Figure 10B:
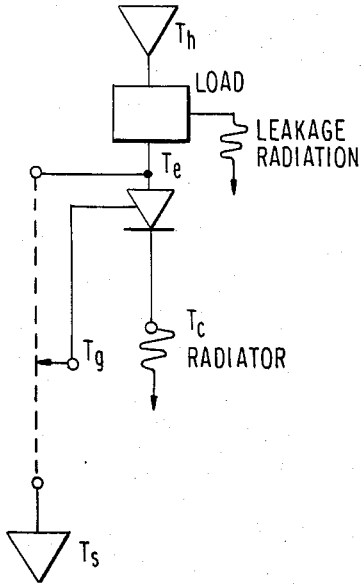

FIGS. 10*a* and 10*b* illustrate two ways in which a temperature divider can be combined with a power valve to yield a two-terminal device that functions like a variable-bias thermal diode. (The device illustrated in FIG. 10*b* actually has three terminals, but one of these is connected to a fixed-temperature ($T=T_s$) cold heat sink.) In the case of FIG. 10*a*, the two free terminals are indicated by the black dots labelled $T_e$ and $T_c$. These are connected respectively to a load and to a radiator. When the valve is in its non-conducting condition, the radiator will be cold, and $T_e$ will increase because the hot reservoir at temperature $T_h$ is supplying heat to the load faster than heat is lost by leakage radiation. The grid temperature $T_g$ has a value intermediate between the load temperature $T_e$ and the radiator temperature $T_c$, that depends on its setting. $T_g$ rises as $T_e$ rises until it exceeds $T_g^{co}$, at which point the valve becomes conducting. This feeds heat to the radiator, whose temperature $T_c$ then rises to a value not much below $T_e$. Because $T_g$ must lie between these two values, when the valve becomes conducting it rises from a value just above $T_g^{co}$ to a value just below $T_e$, and this locks the valve into its conducting condition. The load is now effectively directly connected to the large radiator, and loses heat faster than the hot reservoir can supply it, so its temperature $T_e$ falls, and $T_c$ and $T_g$ fall along with it until $T_g$ reaches $T_g^{co}$ (at which point $T_e$ will be only slightly above $T_g^{co}$, and $T_c$ slight below it). At this point the valve becomes non-conducting and the load is disconnected from the radiator whose temperature drops while the load temperature rises until the cycle repeats itself. Thus the thermal circuit constitutes a relaxation oscillator whose maximum temperature is determined by the setting of the temperature divider, but whose minimum temperature is essentially independent of this setting, being only slightly greater than $T_g^{co}$, which is determined by the construction of the valve. Because the period of the oscillator is decreased when the maximum load temperature is decreased, it is evident that the frequency of the oscillator can be regulated by adjusting the setting of the temperature divider. Such a variable-frequency oscillator could be used as a timer in a periodic thermal process. In this case, the valve could be an amplifier valve instead of a power valve, and either $T_e$ or $T_c$ could be used as the control temperature of a power valve. The valve-divider combination of FIG. 10*a* is analogous in its behavior to that of a thyrotron whose firing voltage can be regulated by changing the grid bias, but once firing commences the grid losed control until the plate voltage falls to a value that is too low to support conduction.

FIG. 10*b* illustrates a circuit in which the grid does not lose control. In this case, the cold end of the temperature divider is connected to a constant temperature cold sink at temperature $T_s$, instead of to the variable-temperature radiator. $T_g$ is now given by an expression like eq. 5 with $T_{in}$ replaced by $T_s$. Thus there is no hysteresis in the relation between $T_e$ and $T_g$, with the result that variations in $T_e$ will be confined to a narrow range slightly above the value $$T_e^{co}=\alpha T_g^{co}+(1-\alpha)T_s \tag{17}$$

where $T_e^{co}$ is the value of $T_e$ that causes the valve to become non-conducting. If $T_e$ is used as the source temperature for some thermal process, it will remain nearly constant despite wide fluctuations in the primary source whose temperature is $T_h$. That is, the regulated source with temperature $T_e$ will behave almost like a constant-temperature reservoir similar to one involving two-phase equilibrium, with the very significant advantage that the temperature of the reservoir can be changed simply by changing the setting of the temperature divider.

REFERENCES

1. P. D. Dunn and D. A. Reay, "Heat Pipes", 2nd edition (Pergamon, New York, 1978)
2. N. O. Young, J. S. Goldstein, and M. J. Block, J. Fluid Mech. 6, 350 (1959)
3. L. L. Lacy, W. K. Witherow, B. R. Facemire, and G. M. Nishioka, NASA Technical Memorandum TM −82494 (1982)
4. J. J. Bikerman, "Physical Surfaces" (Academic, New York, 1970)
5. International Critical Tables, Vol. IV (McGraw-Hill, New York, 1928)
6. Landolt-Bornstein, Vol. II, Part. 3, 6th edition (Springer-Verlag, New York, 1956)
7. M. Hansen, "Constitution of Binary Alloys", 2nd edition (McGraw-Hill, New York, 1956)
8. L. A. Schmid, J. Appl. Phys. 53(12), 9204 (Dec. 1982)

PATENT REFERENCES

U.S. Pat. No. 3,519,067
U.S. Pat. No. 3,587,725
U.S. Pat. No. 3,818,980
U.S. Pat. No. 3,700,028

I claim:

1. In the method of transferring heat by the evaporation of a working fluid in an evaporator and the condensing of the resulting vapor in a condenser to form condensate, the direction of heat flow being from the evaporator to the condenser, and the condensate being returned to the evaporator, the improvement for controlling the amount of heat flow comprising the steps of:

interrupting the return flow of condensate to produce droplets of condensate, and controlling the temperature at the point of droplet production to control the rate of droplet production and, thus, the rate at which condensate is returned to the evaporator.

2. The improvement of claim 1 wherein the interrupting step comprises passing the condensate through a grid having openings therein, and wherein the controlling step comprises controlling the temperature of the grid.

3. The improvement of claim 2 further comprising the step of interposing a layer of valve fluid immediately downstream of the grid, the valve fluid being substantially immiscible with the working fluid and having a boiling temperature higher than the operating temperature of the evaporator, whereby the droplets return through the valve fluid to the evaporator under the action of thermocapillary forces.

4. The improvement of claim 3 wherein the valve fluid is more dense than the working fluid so that, in a gravitational field, buoyancy forces supplement said thermocapillary forces.

5. The improvement of claim 3 comprising the step of permitting the controllable grid temperature to swing above the evaporator temperature to stop the flow of said droplets by reversing the direction of said thermocapillary forces.

6. The improvement of claim 2 further comprising the step of maintaining the controllable grid temperature below the operating temperature of the evaporator.

7. The improvement of claim 6 further comprising the step of maintaining the controllable grid temperature below the operating temperature of the condenser.

8. The improvement of claim 2 wherein the grid is floating so that its temperature is automatically controlled by the respective evaporator and condenser temperatures.

9. In an heat-transferring device of the type in which heat is transferred by the evaporation of a working fluid in an evaporator and the condensing of the resulting vapor in a condenser to form a condensate, the direction of heat flow being from the evaporator to the condenser, and the condensate being returned to the evaporator, the improvement of means for controlling the amount of heat flow comprising:

interrupting means for interrupting the return flow of condensate to produce droplets of condensate; and temperature-controlling means for controlling the temperature at the point of droplet production to control the rate of droplet production and, thus, the rate at which condensate is returned to the evaporator.

10. The improvement of claim 9 wherein said interrupting means comprises an heat-conducting grid having openings therein for forming the droplets, and wherein said temperature-controlling means comprises means for varying the temperature of the grid.

11. The improvement of claim 10 further comprising a layer of valve fluid disposed immediately downstream of said grid, the valve fluid being substantially immiscible with the working fluid and having a boiling temperature higher than the operating temperature of the evaporator, whereby the droplets return through the valve fluid to the evaporator under the action of thermocapillary forces.

12. The improvement of claim 11 wherein the valve fluid is more dense than the working fluid so that, in a gravitational field, buoyancy forces supplement said thermocapillary forces.

13. The improvement of claim 9 wherein the device is oriented with the condenser above the evaporator whereby the condensate is forced through said grid by gravity.

14. The improvement of claim 9 wherein the device is rotating whereby the condensate is forced through said grid by centrifugal force.

15. The improvement of claim 9 further comprising means for coupling the evaporator, condenser and said temperature-controlling means to respective heat pipes.

16. The improvement of claim 11 further comprising means for confining, and accommodating the varying volume of, said valve fluid and included droplets.

17. The improvement of claim 16 wherein said confining means comprises a fine corrugated mesh which is preferentially wetted by the working fluid.

18. The improvement of claim 9 further comprising means for connecting said device in a thermal amplifier circuit.

* * * * *